US005727701A

United States Patent [19]

Rhoades

[11] Patent Number: 5,727,701

[45] Date of Patent: Mar. 17, 1998

[54] VANITY ORGANIZER

[75] Inventor: Pamela S. Rhoades, Spanish Fort, Ala.

[73] Assignee: LauraMI Industries, Inc., Spanish Fort, Ala.

[21] Appl. No.: 631,051

[22] Filed: Apr. 12, 1996

[51] Int. Cl.[6] ..... A47F 7/00

[52] U.S. Cl. ..... 211/70.6

[58] Field of Search ..... 211/70.6, 60.1; 248/314; 28/73

[56] References Cited

U.S. PATENT DOCUMENTS

| | | | |
|---|---|---|---|
| D. 241,208 | 8/1976 | West, III | D28/73 X |
| D. 347,538 | 6/1994 | Fleischer | D28/73 X |
| D. 372,189 | 7/1996 | Andis et al. | D28/73 X |
| D. 374,312 | 10/1996 | Edgar | D28/73 |
| 3,229,947 | 1/1966 | White | 248/314 |
| 3,710,997 | 1/1973 | Asikainen | 211/60.1 X |
| 3,964,708 | 6/1976 | Reeves | 248/314 X |
| 4,159,773 | 7/1979 | Losenno | 211/70.6 |
| 4,219,178 | 8/1980 | Assion | 248/314 |
| 4,225,106 | 9/1980 | Eplan | 248/314 X |
| 4,629,153 | 12/1986 | Marcum | 248/314 X |
| 4,696,447 | 9/1987 | Strecker | 248/314 X |
| 4,746,090 | 5/1988 | Hamilton | 248/314 |
| 4,852,844 | 8/1989 | Villaveces | 248/314 |
| 4,898,309 | 2/1990 | Fischer | 248/314 X |
| 5,054,615 | 10/1991 | Stillwagon et al. | 211/70.6 X |
| 5,064,154 | 11/1991 | Payne | 248/314 X |
| 5,485,931 | 1/1996 | Barr, Jr. | 211/70.6 |

*Primary Examiner*—Alvin C. Chin-Shue
*Assistant Examiner*—Sarah L. Pyrol
*Attorney, Agent, or Firm*—Breiner & Breiner

[57] ABSTRACT

A vanity organizer comprising a backing plate, a y-shaped tubular member connected to the backing plate and constructed and arranged for receiving one or more curling irons, and a ring member connected to the backing plate and constructed and arranged for receiving and holding a hair dryer.

5 Claims, 1 Drawing Sheet

VANITY ORGANIZER

FIELD OF INVENTION

This invention relates generally to a vanity organizer. In particular, this invention relates to a vanity organizer for holding two curling irons and a hair dryer.

BACKGROUND OF THE INVENTION

Men, women and children in most families use hair dryers and curling irons for styling their hair. Curling irons and hair dryers are most commonly used in the bathroom and stored in the bathroom. Usually, these items are stored in a vanity underneath the bathroom sink or are left out on the vanity counter. Storing the items in the vanity renders the items less accessible and it takes more time to retrieve and replace the items. More often than not, the items are left on the vanity counter. This takes up counter space which can be used for other items and leaves the vanity counter cluttered and not useful to other family members. Accordingly, there is a need for a vanity organizer which will hold and maintain one or more curling irons and a hair dryer in a convenient manner for ease of use by family members.

A search of the U.S. Patent and Trademark Office records indicates that others have proposed various devices for maintaining curling irons or hair dryers. For example, U.S. Pat. Nos. 4,159,773; 4,973,019; 4,446,972; 4,871,074; 1,540,959 and 471,752 disclose various devices for maintaining hair dryers, curling irons or the like. However, none of these devices provide a vanity organizer which is simple and inexpensive to manufacture, which is easy to install and which provides a convenient means for holding such items. The present invention has solved these problems as will be more apparent hereinafter.

PRIMARY OBJECTS AND SUMMARY OR THE INVENTION

It is a primary object of the invention to provide a vanity organizer for maintaining one or more curling irons and a hair dryer.

It is a further primary object of the invention to provide a vanity organizer which is easy to install and which provides quick and convenient storage of hair styling tools.

It is a further primary object of the invention to provide a vanity organizer of simple construction and which is easy and inexpensive to manufacture.

The vanity organizer of the invention comprises a backing plate, a generally y-shaped tubular member connected to the backing plate and constructed and arranged for receiving and holding one or more curling irons, and a ring member connected to the backing plate and constructed and arranged for receiving a hair dryer. Preferably, the vanity organizer is constructed of plastic and, therefore, is light-weight. The vanity organizer of the invention is easy to install and may be mounted on a wall or on a vanity. The vanity organizer allows for easy access to items such as a curling iron or hair dryer in close relation to a vanity or a mirror in the bathroom for styling one's hair. After the curling iron or hair dryer has been used, it may be replaced quickly and securely in the vanity organizer of the invention. This allows for efficient use of the bathroom space and the bathroom is, therefore, kept neat and organized.

BRIEF DESCRIPTION OF DRAWINGS

Other objects, advantages and novel features of the present invention will become apparent from the following detailed description of the invention when considered in conjunction with the accompanying drawing, in which like reference numerals designate like parts throughout the figures thereof, and wherein.

DETAILED DESCRIPTION OF THE INVENTIONS

Figure 1:
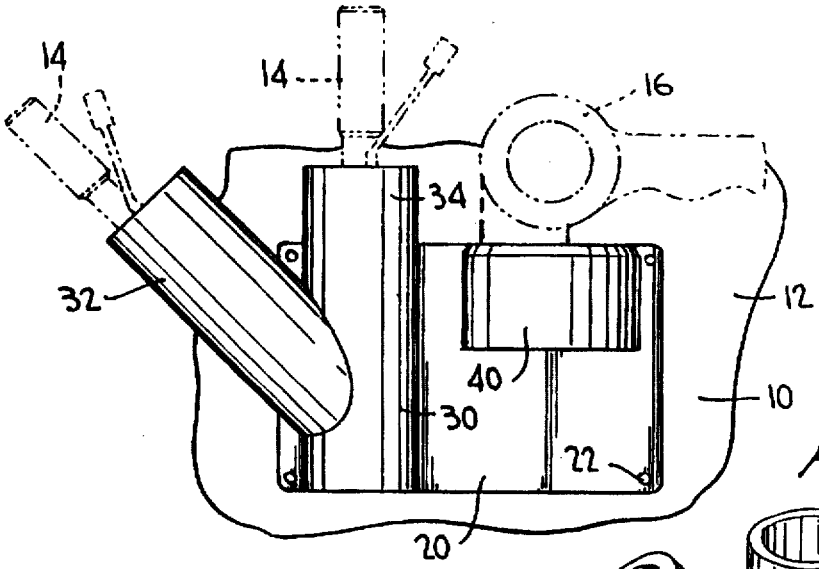
FIG. 1 is a front side view of the vanity organizer attached to a wall surface and showing placement (in phantom lines) of two curling irons and a hair dryer.
Figure 2:
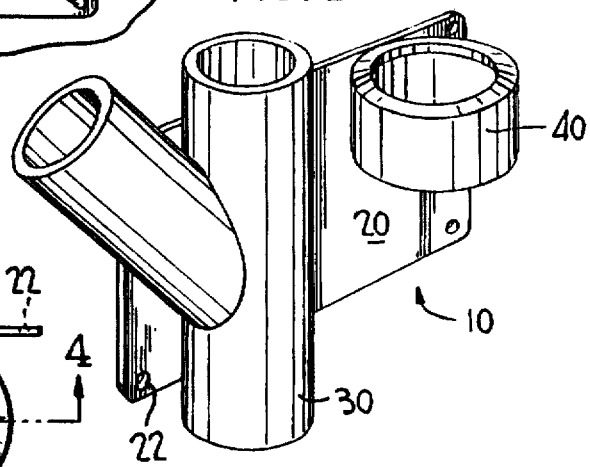
FIG. 2 is a perspective side view of the vanity organizer of the invention.

Referring to FIG. 1, a vanity organizer 10 is shown attached to a wall 12. Curling irons 14 and hair dryer 16 (shown in phantom lines) are stored in the vanity organizer 10.

The vanity organizer 10 includes a backing plate 20. The backing plate is preferably made of a hard plastic and includes openings 22 for receiving screws or the like (not shown) for mounting the vanity organizer 10 to a wall, vanity or other surface. The vanity organizer is preferably mounted in close relation to a bathroom vanity or mirror where one normally styles their hair.

Figure 3:
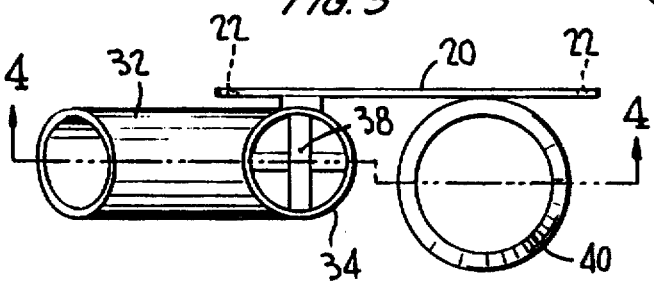
FIG. 3 is a top view of the vanity organizer of the invention.
Figure 4:
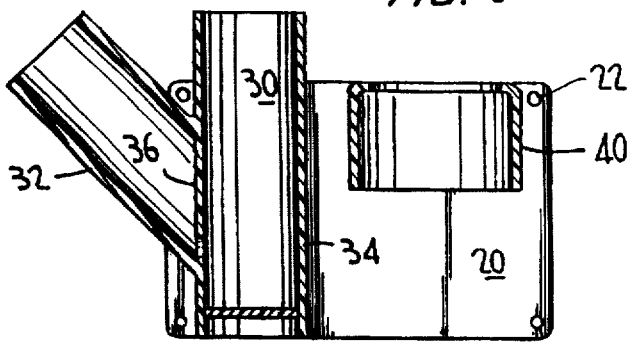
FIG. 4 is a cross-section of the vanity organizer taken along lines 4—4 of FIG. 3.

Attached to the backing plate 20 is a generally y-shaped tubular member 30. The tubular member 30 is connected to the mounting plate 20 by any suitable means such as mounting screws or an adhesive. Alternatively, the entire vanity organizer 10 may be manufactured by injection molding. In the preferred embodiment, the y-shaped tubular member 30 is attached to the mounting plate by two screws (not shown). The y-shaped tubular member 30 includes a first tubular member 32 and a second tubular member 34 each constructed and arranged for receiving a hair styling tool, preferably, curling irons 14. The tubular members 32 and 34 are approximately 2 inches in diameter, although different sizes may be used without departing from the scope of the invention. Tubular member 32 has a closed bottom portion 36 which abuts tubular member 34. Tubular member 34, as shown in FIG. 3, has cross bars 38 which comprise the bottom of the tubular member 34. It is understood that the bottom portion of the tubular member 34 may be completely closed by a suitable plate member. The y-shaped tubular member 30 may be made of plastic and, in the preferred embodiment, is made of the same plastic as backing plate 20.

A ring member 40 is attached to backing plate 20. The ring member 40 is constructed and arranged for receiving and securely holding a hair dryer 16. Ring member 40 is preferably made of the same plastic material as y-shaped tubular member 30 and backing plate 20. A preferred size of ring member 40 is a 3 inch diameter. Similar to y-shaped tubular member 30, ring member 40 is attached to backing plate 12 by an adhesive or a screw means.

In use, the vanity organizer 10 is mounted to a wall or vanity in the bathroom or adjacent a mirror used for hair styling. Curling irons 14 may be stored in the y-shaped tubular member 30 and a hair dryer 16 in the ring member 40. It is understood that other items such as a styling brush or the like may be stored in the y-shaped tubular member 30.

The above-described invention provides for a vanity organizer which is inexpensive to manufacture and simple to install and use. While a preferred embodiment of the vanity organizer has been described in detail above, various modifications and variations of the invention are possible in light of the above teachings. It is, therefore, to be understood that, within the scope of the appended claims, the invention may be practiced otherwise than as above-described.

It is claimed:

1. A vanity organizer comprising a backing plate, a member having a y-shaped body having two openings and connected to said backing plate and constructed and arranged for receiving one or more curling irons, and a ring member connected to said backing plate and adjacent to said y-shaped member and constructed and arranged for receiving a hair dryer.

2. The vanity organizer according to claim 1 wherein the vanity organizer is plastic.

3. The vanity organizer of claim 1, wherein the y-shaped tubular member includes a first tubular member having a closed end portion and a second tubular member having a bottom portion closed by a cross bar means.

4. The vanity organizer of claim 1 wherein said backing plate includes means for securing said backing plate to a wall surface.

5. A vanity organizer comprising a backing member having means for securing said backing member to a wall surface, a member having a y-shaped body having two openings and connected to said backing member and constructed and arranged for receiving one or more curling irons, wherein the y-shaped member includes a first member having a closed end portion and a second member having a bottom portion having a means for securing in place said curling iron, and a ring member connected to said backing member and adjacent to said y-shaped member and constructed and arranged for receiving a hair dryer.

* * * * *